US007601206B2

(12) United States Patent
Call et al.

(10) Patent No.: US 7,601,206 B2
(45) Date of Patent: Oct. 13, 2009

(54) METHOD AND APPARATUS FOR GENERATING WATER USING AN ENERGY CONVERSION DEVICE

(75) Inventors: Charles J. Call, Albuquerque, NM (US); Robert C. Beckius, Placitas, NM (US); Ezra L. Merrill, Albuquerque, NM (US); Seung-Ho Hong, Richland, WA (US); Mike Powell, Kennewick, WA (US)

(73) Assignee: MesoSystems Technology, Inc., Albuquerque, NM (US)

( * ) Notice: Subject to any disclaimer, the term of this patent is extended or adjusted under 35 U.S.C. 154(b) by 396 days.

(21) Appl. No.: 11/507,711

(22) Filed: Aug. 22, 2006

(65) Prior Publication Data

US 2009/0223236 A1 Sep. 10, 2009

(51) Int. Cl.
*B01D 53/06* (2006.01)

(52) U.S. Cl. ..... 96/125; 95/113; 95/116; 96/126; 96/127

(58) Field of Classification Search ..... 95/113; 96/125, 126, 146, 127
See application file for complete search history.

(56) References Cited

U.S. PATENT DOCUMENTS

| | | | | |
|---|---|---|---|---|
| 2,138,689 | A | 11/1938 | Altenkirch | 55/33 |
| 2,993,563 | A | 7/1961 | Munters et al. | 55/34 |
| 3,400,515 | A | 9/1968 | Ackerman | 55/33 |
| 3,490,201 | A | 1/1970 | Colvin et al. | 55/34 |
| 3,844,737 | A | 10/1974 | Marriss et al. | |
| 4,012,206 | A | 3/1977 | Macriss et al. | 55/34 |
| 4,146,372 | A | 3/1979 | Groth et al. | |
| 4,185,969 | A | 1/1980 | Bulang | 55/31 |
| 4,219,341 | A | 8/1980 | Hussmann | |
| 4,235,608 | A | 11/1980 | Watanabe et al. | 55/181 |
| 4,304,577 | A | 12/1981 | Ito et al. | |
| 4,342,569 | A | 8/1982 | Hussmann | |
| 4,344,778 | A | 8/1982 | Matsuoka et al. | |
| 4,365,979 | A | 12/1982 | Takeyama et al. | 55/181 |
| 4,926,618 | A | 5/1990 | Ratliff | 95/10 |
| 5,170,633 | A | 12/1992 | Kaplan | |
| 5,242,473 | A | 9/1993 | Ogasahara | |
| 5,512,083 | A | 4/1996 | Dunne | 95/113 |
| 5,526,651 | A | 6/1996 | Worek et al. | |
| 5,709,736 | A | 1/1998 | Fujimura | |
| 5,732,562 | A | 3/1998 | Moratalla | 62/94 |
| 5,878,590 | A | 3/1999 | Kadle et al. | 62/271 |
| 5,931,015 | A | 8/1999 | Maeda | |
| 6,029,462 | A | 2/2000 | Denniston | 62/94 |
| 6,099,623 | A | 8/2000 | Namatame et al. | |
| 6,156,102 | A | 12/2000 | Conrad et al. | |
| 6,230,503 | B1 | 5/2001 | Spletzer | |

(Continued)

FOREIGN PATENT DOCUMENTS

| | | |
|---|---|---|
| JP | 5-245333 | 9/1993 |

*Primary Examiner*—Duane Smith
*Assistant Examiner*—Karla Hawkins
(74) *Attorney, Agent, or Firm*—Ronald M. Anderson

(57) ABSTRACT

Potable water is produced by extraction of water vapor from air. Water absorbed inside a desiccant bed is forced into vapor phase by using input heat energy, for example, waste heat from the exhaust of an internal combustion engine. Pre-heating a portion of the desiccant material prior to desorption enhances efficiency. Energy for the pre-heating may be obtained by recovering heat from the desiccant material prior to adsorption.

16 Claims, 6 Drawing Sheets

U.S. PATENT DOCUMENTS 6,360,549 B1 3/2002 Spletzer et al.
6,453,684 B1 9/2002 Spletzer et al.
6,547,853 B2 4/2003 Fukuhori et al. ..... 95/113
6,588,225 B1 7/2003 Hodgson et al.
6,755,037 B2 6/2004 Engel et al.
7,007,495 B2 3/2006 Lee et al. ..... 62/271
7,017,356 B2 3/2006 Moffitt ..... 62/91
7,077,187 B2 7/2006 Cargnelli et al. ..... 165/4
7,251,945 B2 8/2007 Tongue ..... 62/93

METHOD AND APPARATUS FOR GENERATING WATER USING AN ENERGY CONVERSION DEVICE

GOVERNMENT LICENSE RIGHTS

The U.S. Government has a paid-up license in this invention and the right in limited circumstances to require the patent owner to license others on reasonable terms as provided by the terms of TACOM contract DAAE07-02-C-L054.

FIELD OF THE INVENTION

The present invention pertains to the art of producing potable water. More particularly, the present invention pertains to the production of potable water by extraction of water vapor from air with subsequent condensation of the vapor to obtain liquid water.

BACKGROUND OF THE INVENTION

Providing water in remote locations is often quite difficult. For example, soldiers in the field require between 1.5 and 7 gallons of water per day for drinking, washing, and food preparation. Supplying this water to widely distributed ground troops presents a significant logistical burden to the U.S. Military. In some instances, soldiers can obtain water from local water supplies (e.g., civilian supplies, rivers, and lakes), but in cases where no local water is available or where it is potentially contaminated, trucks, helicopters, and other vehicles deliver water to the forward-deployed soldiers. Similar logistical problems face non-governmental organizations performing relief work in remote areas.

The logistical burden of water delivery could be mitigated if soldiers could instead produce their own water directly from water vapor in ambient air. Atmospheric air contains water at concentrations typically between 0.003 and 0.03 kg of water vapor per kg of air. Extraction of logistically significant quantities of water from the air can require processing large air volumes. However, the potential reduction in the burden of delivering water to soldiers in the field makes extraction of water from air worthy of consideration.

Numerous techniques have been developed to obtain potable water in remote locations. One basic technique is the "solar still" in which a clear barrier is extended over a source of moisture (a pit dug into the soil or a source of non-potable water), solar radiation is used to evaporate water from the source, and potable water is condensed and collected from the underside of the barrier. This technique has limited applications since it cannot produce large amounts of potable water and depends on both solar energy and a vaporizable source of moisture. The utility of solar stills has generally been limited to emergency or survival situations.

Another technique has been to condense moisture in the air by forcing moisture-laden air over a refrigerated coil with a fan and collecting the condensed water. This method has typically been used by dehumidifiers, but suffers from the relative inefficiency of the refrigeration cycle as well as the growth of contaminants on the exposed condensation surfaces. For further details, refer to the examples of U.S. Pat. No. 6,755,037 and U.S. Pat. No. 6,588,225.

A further method for extracting water from air is to compress the air to the point where water vapor condenses to form liquid water. This method typically requires large amounts of energy and equipment involving many moving parts including seals that must withstand high pressures. The cost and complexity of this method makes it unattractive. For further details, refer to the examples of U.S. Pat. No. 6,453,684, U.S. Pat. No. 6,360,549, and U.S. Pat. No. 6,230,503.

Yet another technique, likewise used for both dehumidification and water production, has been the extraction of water from air via adsorption with a desiccant. Some of these desiccant systems used to produce potable water use liquid desiccant, which require complicated controls. For example, refer to U.S. Pat. No. 6,156,102. Other such systems use a fixed desiccant, such as silica gel or zeolite, in a batch process. These systems are limited in that the batch process limits the time the systems are used. For example, refer to U.S. Pat. No. 4,344,778, U.S. Pat. No. 4,342,569, U.S. Pat. No. 4,219,341, and U.S. Pat. No. 4,146,372. To overcome this limitation, some water producing systems have used plural desiccant beds in an alternating batch process. For further details, refer to the example of U.S. Pat. No. 4,304,577.

While rotating desiccant wheels have been more commonly employed in dehumidifying air conditioning systems that require continuous operation, the desorbed water is left in the waste streams in these systems. For further details, refer to the examples of U.S. Pat. No. 6,099,623, U.S. Pat. No. 5,931,015, U.S. Pat. No. 5,709,736, U.S. Pat. No. 5,526,651, U.S. Pat. No. 5,242,473, U.S. Pat. No. 5,170,633 and U.S. Pat. No. 3,844,737.

It has been proposed to use a rotating desiccant wheel for the production of liquid water from moisture in the air. Such a system adsorbs water from an incoming air stream on a portion of an intermittently rotated desiccant wheel. The wheel rotates to align with a desorbing section in which a recirculating air supply is heated with an electric heater, passed through the wheel to desorb water and regenerate the desiccant, and then passed over a condenser to condense liquid water. The energy requirements of the condenser and the heater in this system limit its efficiency and utility. For further details, refer to the example of U.S. Pat. No. 4,365,979.

SUMMARY OF THE INVENTION

Water absorbed inside a desiccant bed is forced into vapor phase by using energy from an energy conversion device (ECD). An ECD is defined as any device that converts potential energy to electrical energy and/or heat energy. The potential energy can come from numerous sources including (but not limited to) chemical, mechanical, or solar sources. The energy (electrical and/or heat) produced by the ECD is useful for collecting water from humidity in the ambient air.

An apparatus embodying the present invention has access to an ECD, and it has a rotating desiccant rotor that is divided into adsorption and desorption portions. The apparatus also has an ambient air blower, a circulating desorption fan, a heat exchanger, a water condenser, and a pre-heating module. The desorption portion has two sections, a pre-heating section and main desorbing section. The adsorption portion also has two sections, a heat recovery section and main adsorbing section.

During operation, ambient air is driven by the ambient air blower and forced through the main adsorbing section of the desiccant rotor, which absorbs water from the ambient air. Simultaneously, another fan circulates air through a plurality of desorbing channels. In the desorbing channels, the air temperature is elevated by energy from the ECD prior to entering the desorbing section of the desiccant rotor. This high temperature/low-humidity-air then extracts the water from the desiccant rotor and passes it through a heat exchanger and a condenser. The condenser may be cooled by ambient air or an active cooling system. Once the system reaches a steady-operating condition, the relative humidity (RH) of the desorbing air downstream of the condenser reaches 100% and liquid water is collected.

One aspect of the present invention is the use of a rotating desiccant rotor to adsorb water from air and to then desorb water vapor from the desiccant rotor using desorbing air that has been heated by energy from an energy conversion device.

Another aspect of the present invention is the use of heat that has been recovered from elsewhere in the system to heat the desorbing air.

Another aspect of the present invention is the use of a closed channel-loop to keep the relative humidity of air at about 100% downstream of the condenser.

Another aspect of the present invention is the pre-heating of a portion of the rotating desiccant rotor to increase the water production rate.

Another aspect of the present invention is the recovery of heat from a portion of the rotating desiccant rotor to increase the water production rate.

According to one embodiment of the present invention, an apparatus extracts water from ambient air. The apparatus has a desiccant rotor, an adsorption fan disposed to force ambient air to contact a section of the desiccant rotor that lies within a main adsorption flow path, and a desorption fan disposed to force a closed loop of desorping air to contact a section of the desiccant rotor that lies within a main desorption flow path. A condenser is disposed to contact the desorping air so that water vapor in the desorping air is condensed as liquid water. A main heat exchanger is disposed to contact the desorping air so that the temperature of the desorping air is raised by heat energy transferred via the main heat exchanger. The apparatus also has a second heat exchanger, which has a hot side and a cold side. A pre-heating circulation fan is disposed to force pre-heating air to contact a section of the desiccant rotor lying within a pre-heating flow path, and to contact the hot side of the second heat exchanger. A heat recovery circulation fan is disposed to force heat recovery air to contact a section of the desiccant rotor lying within a heat recovery flow path, and to contact the cold side of the second heat exchanger.

According to another embodiment of the present invention, a method is provided for extracting water from ambient air. The method has a step of forcing ambient air to contact a section of a desiccant rotor lying within a main adsorption flow path, and a step of forcing a closed loop of desorping air to contact another section of the desiccant rotor lying within a main desorption flow path. The desorping air is passed over a condenser so that water vapor in the desorping air is condensed as liquid water. The desorping air is caused to contact a main heat exchanger disposed to so that the temperature of the desorping air is raised by heat energy transferred via the main heat exchanger. Pre-heating air is forced to contact a section of the desiccant rotor lying within a pre-heating flow path, and to contact a hot side of a second heat exchanger. Heat recovery air is forced to contact a section of the desiccant rotor lying within a heat recovery flow path, and to contact a cold side of the second heat exchanger.

According to a further embodiment of the present invention, an apparatus is provided that extracts water from ambient air. The apparatus has a desiccant rotor and a means for forcing ambient air to contact a section of the desiccant rotor lying within a main adsorption flow path. The apparatus also has a means for forcing a closed loop of desorping air to contact another section of the desiccant rotor lying within a main desorption flow path. Additionally, the apparatus has a condenser and a means for passing the desorping air over the condenser so that water vapor in the desorping air is condensed as liquid water. The apparatus further has a main heat exchanger and a means for contacting the desorping air with the main heat exchanger disposed so that the temperature of the desorping air is raised by heat energy transferred via the main heat exchanger. The apparatus also has a second heat exchanger, a means for forcing pre-heating air to contact a section of the desiccant rotor lying within a pre-heating flow path, and to contact a hot side of the second heat exchanger, and a means for forcing heat recovery air to contact a section of the desiccant rotor lying within a heat recovery flow path, and to contact a cold side of the second heat exchanger.

DETAILED DESCRIPTION

The present invention relies upon thermal-swing adsorption, a process in which air is passed over the surface of an adsorbent, and water is collected from the air, typically in an adsorbed state inside small-diameter pores. Recovery of the water from the adsorbent requires addition of heat typically in excess of water's latent heat of vaporization, which is roughly 2400 J/g at room temperature. With sufficient heat addition, though, the water will desorb and form a high-humidity, high-temperature mixture of water vapor and air. Passing this mixture through a suitable condenser (e.g., air-cooled) allows the water to be collected as liquid.

Figure 1:
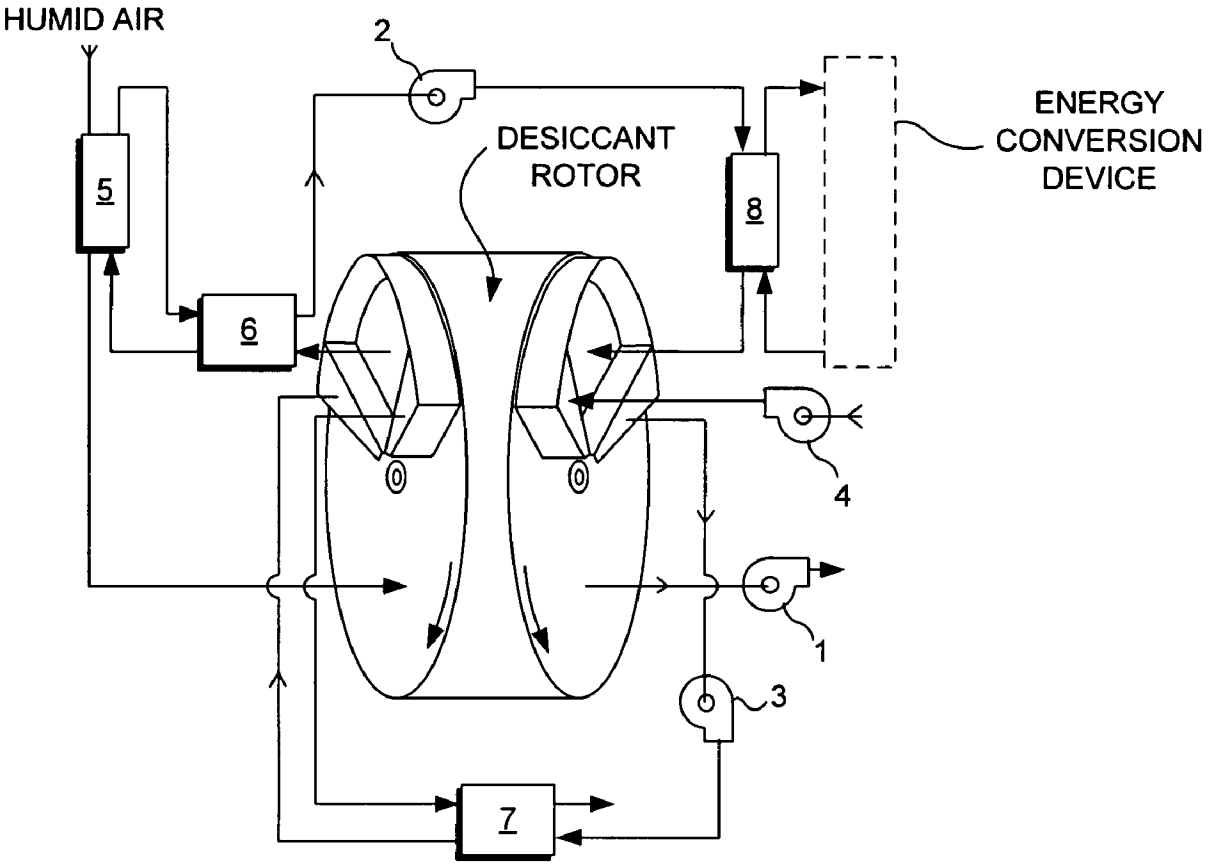
FIG. 1 illustrates a schematic diagram of a system according to one embodiment of the present invention.

Referring to FIG. 1, a schematic diagram of a system according to one embodiment of the present invention is illustrated. The rotating desiccant rotor is divided into two different portions, an absorbing portion and a desorbing portion. The desorption portion has two sections, a pre-heating section and a main desorbing section. The adsorption portion has two sections, a heat recovery section and a main adsorbing section. The adsorption fan 1 moves ambient air through the main adsorbing section of the adsorbing portion of the rotating desiccant rotor 10. The desorption circulation fan 2 moves a closed loop of desorbing air through the main desorption section of the desorption portion of the rotating desiccant rotor 10, an auxiliary heat exchanger 6, the condenser 5, and the main heat exchanger 8. Heat energy from an energy conversion device moves through the main heat exchanger 8 into the closed loop of desorbing air.

A pre-heating circulation fan 3 moves air in a closed loop through the pre-heating section of the desorption portion of the rotating desiccant rotor 10 and the pre-heat/heat recovery heat exchanger 7. A heat recovery fan 4 moves air through the heat recovery section of the adsorption portion of the rotating desiccant rotor 10 and the pre-heat/heat recovery heat exchanger 7. This arrangement causes transfer of heat energy between the pre-heating section and the heat recovery section via the pre-heat/heat recovery heat exchanger 7.

The auxiliary heat exchanger 6 in the closed loop of desorbing air is optional. Although not strictly required to practice the invention, including the auxiliary heat exchanger 6 enhances overall system efficiency.

For ease of explanation and illustration, the side of the desiccant rotor 10 through which ambient air enters for adsorption is defined as being the upstream side of the rotor, and the opposite side is defined as the downstream side.

Figure 2:
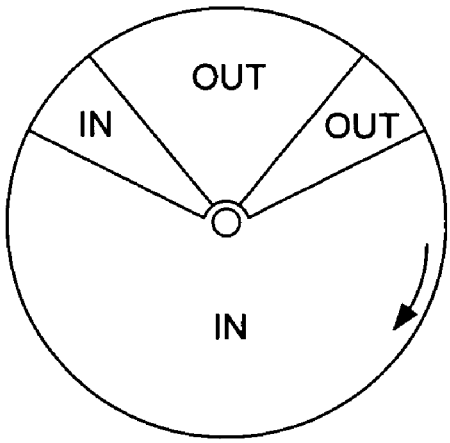
FIG. 2 illustrates a view from the upstream side of the desiccant rotor, with the air flow directionalities as implemented according to an embodiment of the present invention.

Referring to FIG. 2, a view from the upstream side of the rotating desiccant rotor 10 is illustrated. The air flow directionalities as implemented according to the embodiment of FIG. 1 are shown for the various sections, in relation to the rotation direction of the rotor. Air flows into the main adsorbing section and out of the main desorbing section. Air flows out of the heat recovery section and into the pre-heating section.

Figure 3:
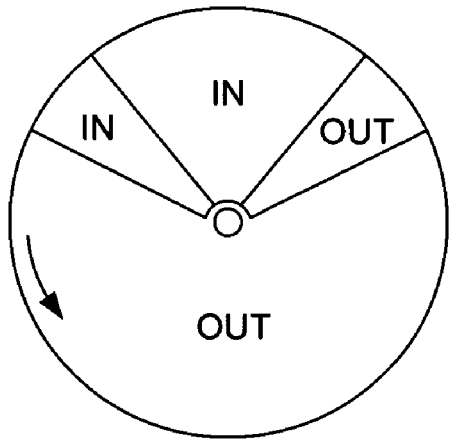
FIG. 3 illustrates a view from the downstream side of the desiccant rotor, with the air flow directionalities as implemented according to an embodiment of the present invention.

Referring to FIG. 3, a view from the downstream side of the rotating desiccant rotor 10 is illustrated. The air flow directionalities as implemented according to the embodiment of FIG. 1 are shown for the various sections, in relation to the rotation direction of the rotor. Air flows out of the main adsorbing section and into the main desorbing section. Air flows into the heat recovery section and out of the pre-heating section.

Figure 4:
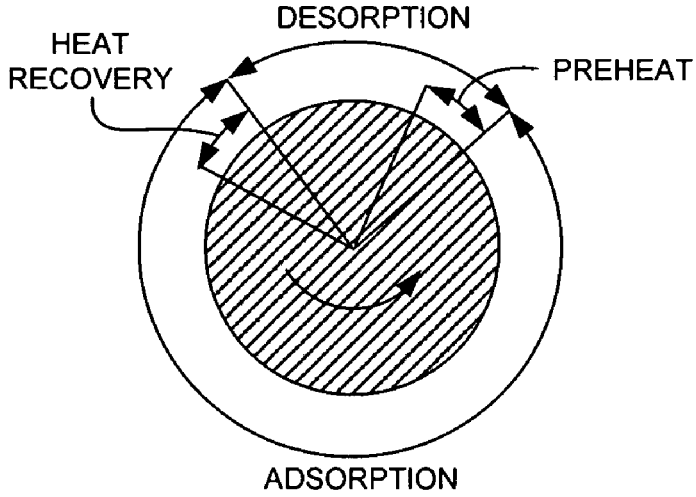
FIG. 4 illustrates, from the vantage point of the downstream side of the desiccant wheel, the functional sections through which the desiccant rotor rotates.

Referring to FIG. 4, the functional sections through which the desiccant rotor rotates are illustrated from the vantage point of the downstream side of the desiccant wheel. The desiccant rotor is divided into adsorption and desorption portions. The absorbing and desorbing portions are also separated into two sections. The desorption portion has a pre-heating section and a main desorbing section. The adsorption portion has a heat recovery section and a main adsorbing section. The size of portions of sections may be modified based upon environmental conditions such as ambient air temperature and relative humidity.

One particularly efficient way to operate an apparatus according to the present invention is to utilize waste heat (such as that produced by a combustion engine, an air conditioner, or a solar energy collector) to heat the desorbing air.

One optional feature that adds to the usefulness of a system embodied according to the present invention is a filtration device that filters the water produced. The filtration device is advantageously disposed between the condenser structure (where the water is condensed into liquid form) and a reservoir for holding the water for later use.

Another optional feature that adds to the usefulness of a system embodied according to the present invention is a taste improvement module. The taste improvement module is advantageously disposed at or inside the water reservoir.

Working Example #1

The present invention has been practiced using a 440 mm diameter and 200 mm depth silica-gel desiccant rotor. An electric heater was used to produce heat for the desorping air path. Cold water was used for the cold side of the condenser. This implementation produced 1.8 liter/hr of water.

Working Example #2

The present invention has been practiced using a 100 mm deep and 270 mm diameter silica-gel rotor. An electric heater was used to produce heat for the desorping air path. The air flow rate through the main adsorption section was about 60-70 cfm and through the main desorption section was 20-25 cfm. This implementation produced 6 L/day with 500 W of energy being input to the desorption air path, and with the ambient air conditions of 40% relative humidity and T=23° C. Water production rose to 8-9 L/day with 500 W being input, and with the ambient air conditions of 70% relative humidity and T=30° C. Maintaining the ambient air conditions of 70% relative humidity and T=30° C., water production rose to 10 L/day with energy input of 600 W, and rose further to 12 L/day with energy input of 800 W.

Working Example #3

The present invention has been practiced using a diesel generator as the ECD. This system produces 1.5 to 2.0 L/hour of water using waste heat from a small diesel engine to desorb the collected water from a continuously rotating desiccant wheel. For every gallon of fuel burned, this system produces roughly 2 gallons of water.

Figure 5:
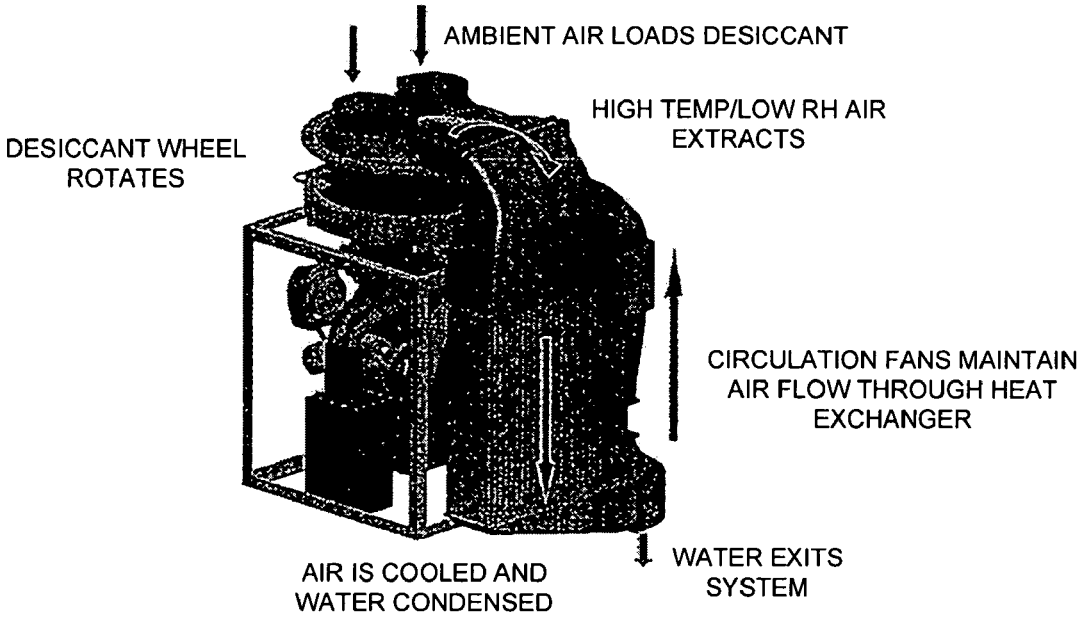
FIG. 5 illustrates the direction of air movement through a working example of the invention.

Referring to FIG. 5, the direction of air movement through the system of Working Example #3 is illustrated. This particular working example of the invention is built around an 8-kW (11 hp) Kubota diesel engine. Waste heat from the engine is extracted from the engine coolant and the exhaust gases and used to desorb water collected on a silica-based desiccant. Air is circulated by fans, which are powered by the small electric generator fitted to the diesel engine. Dual fans on top of the unit direct ambient air downward through three-quarters of the rotating desiccant wheel where water is collected. The dehumidified air exits the desiccant wheel just above the Kubota engine. Simultaneously, hot "scavenger" air flows through one quarter of the desiccant wheel and removes the adsorbed water from the desiccant. The desorbed water is transported to the condenser where it is condensed and collected. The cooled scavenger air is pumped by a small fan back through a compact heater, which in this case is powered by engine-coolant and exhaust-gas heat, before it is directed back to the rotating desiccant wheel.

Figure 6:
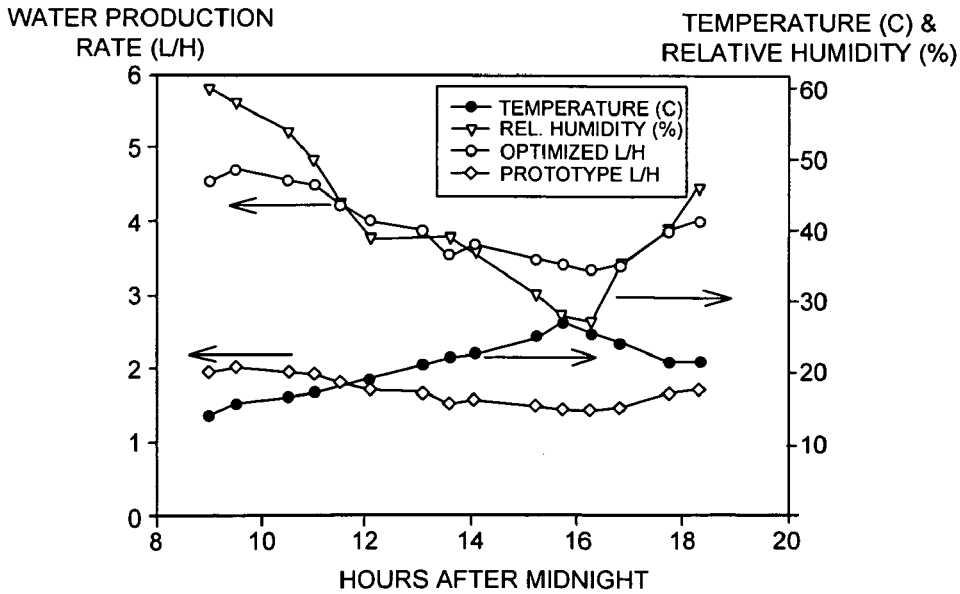
FIG. 6 illustrates typical performance data for the working example of the invention illustrated in FIG. 5.

Referring to FIG. 6, typical performance data for the system of Working Example #3 is illustrated. Water-production rate varies somewhat with ambient conditions, but is in the range of 1.5 to 2.0 L/h. Fuel consumption for the Kubota engine is constant at 0.9 L/h. The water-to-fuel ratio is, therefore, about 2:1. FIG. 6 also shows the theoretical water-production rate, which is the water-production rate that may be obtained from the system if it were modified to take full advantage of all the available waste heat and electrical-generation capacity. In this case, the water-to-fuel ratio exceeds 4:1.

Figure 7:
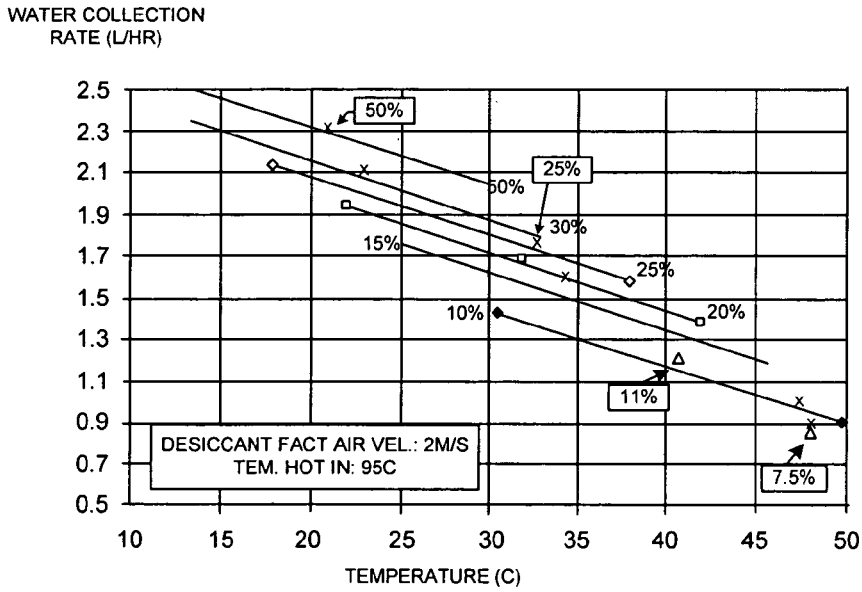
FIG. 7 illustrates the performance of, under varying environmental conditions, of the working example of the invention illustrated in FIG. 5.

Referring to FIG. 7, the performance of the system of Working Example #3 under various environmental conditions is illustrated. The solid lines indicate expected performance based on calculations, lab-scale tests, and measured prototype performance. Data points indicate the observed water-production rates under the indicated conditions.

Three additional design options may be implemented to substantially improve the water-generation efficiency of the present invention. These options are not implemented in Working Example #3. These design options are summarized as:

Improved Electrical Generator—the capacity of the electrical generator can be matched to the peak-efficiency engine operating conditions;

An External Burner—an additional fuel burner can be added to provide makeup heat so the total available heat is commensurate with the electrical-generation capacity of the engine; and Additional Heat Exchangers—compact heat exchangers can be added to improve heat recovery within the system.

The electrical generator on the Kubota engine used for the system of Working Example #3 is not intended to take full advantage of the all the mechanical power produced by the engine. Instead, it provides only about 1 kW of continuous electrical power. An electrical generator designed to fully use the Kubota engine power will produce in excess of 4 kW. It is preferable for the water-from-air system of the present invention to use all the available mechanical engine power to produce electricity.

Additional efficiency may be gained if an external burner is used to generate additional heat because an engine-driven generator will typically produce more electrical energy than embodiments of the present invention can utilize based solely on the excess heat from the engine. It is preferable to capture waste heat from the engine exhaust and coolant system, but this heat will not generally be commensurate with the water-production potential of the available electrical power. Adding an external fuel burner to provide additional heat allows one to match the total heat generation to the engine's electrical-generation capacity.

As illustrated according to Working Example #3, the approach of the present invention uses a continuously rotating desiccant wheel to collect water from ambient air. In a preferred embodiment, the ECD is an internal combustion engine or an internal combustion engine with an auxiliary fuel burner such that heat from the burning of a hydrocarbon fuel (whether generated directly by combustion or as waste heat from an engine) is used to desorb water from the desiccant. The air movement required to bring about water-vapor condensation is provided by a series of electrically driven fans, which are powered by an engine-driven generator. With careful attention to heat recovery and the kinetics of water adsorption and desorption, this method can yield up to about 7 gallons of water per gallon of fuel burned when the system is operated under baseline ambient conditions of 25° C. and 30% relative humidity.

According to the implementation of Working Example #3, heat is not used as efficiently as it might be. Before it is reheated, the scavenger air exiting the condenser can be preheated by the hot, humid scavenger air exiting the desiccant. This is not done in the system of Working Example #3. The scavenger air can be further preheated by the engine exhaust gas. Better heat recovery within the system reduces the need to burn additional fuel for heat production and, thereby, increases system efficiency. This improvement can be accomplished by adding several additional compact heat exchangers to the system.

Figure 8:
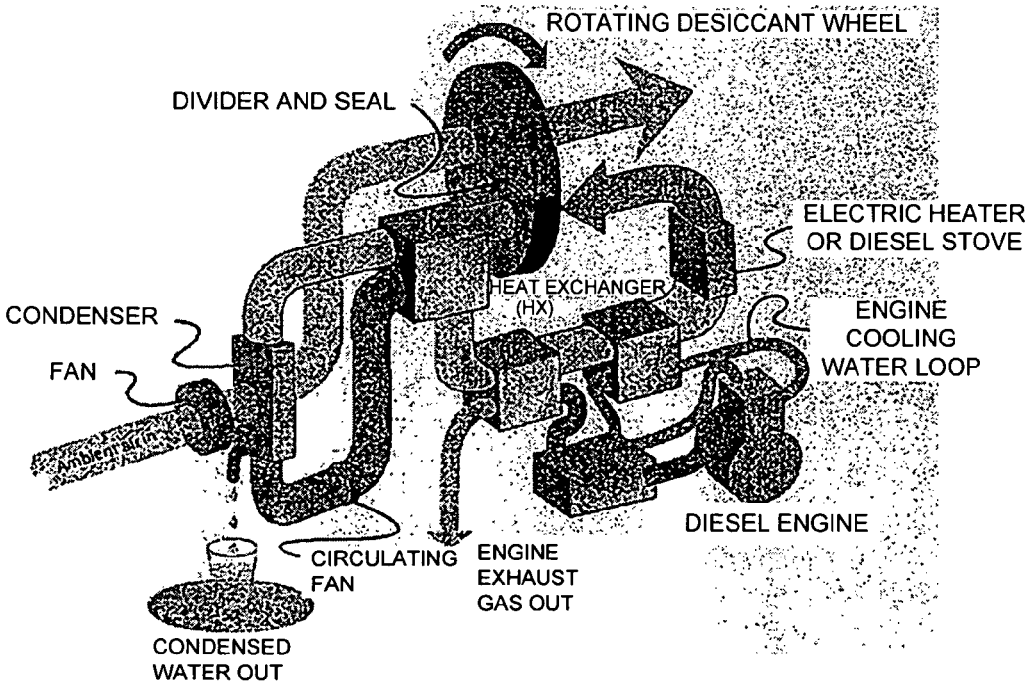
FIG. 8 illustrates a schematic of an alternate embodiment of the invention.

Referring to FIG. 8, a schematic of an alternate embodiment of the present invention is illustrated. During operation, ambient air is pulled through a rotating desiccant wheel, which extracts most of the available water vapor. The dehumidified air is exhausted to ambient. Simultaneously, another fan circulates the scavenger air through the continuous water extraction loop. In the extraction loop, scavenger air flows through a heat exchanger where the air temperature is increased to over 90° C. and the relative humidity is reduced to approximately 2%. The scavenger air then flows through the desorbing section of the desiccant wheel where the dry, high temperature air extracts the adsorbed water. The high-temperature, high-humidity air is then routed through the system condenser where the water is removed and collected for later consumption.

To raise the temperature of the scavenger air stream and keep the energy requirements low, a heat exchanger (located in the extraction loop) uses waste heat from the engine cooling system as well as the engine exhaust. To further reduce power requirements and limit system size, the condenser is placed in-line with the primary system fan and up stream of the adsorption section of the desiccant wheel. In this configuration, the condenser and the adsorption section of the desiccant wheel utilize a single air mover that may be driven either by an electric motor or by the shaft power of the engine.

A diesel-powered burner is incorporated in the scavenger-air extraction loop. The burner elevates the temperature of the desorption stream above the upper limit of the engine heat. This approach makes it possible to increase the fuel efficiency and process airflow by maximizing the engine's electrical energy output and using the energy to power the system fans.

Like Working Example #3, this alternate embodiment can be powered by a Kubota diesel engine. However, this alternate embodiment uses a commercially available 3.5 kW electric generator supplied by Phasor Marine. For further details, refer to the Internet web page at URL http://www.phasormarine.com/lp1-2-2kw.htm.

When operating in ambient conditions of 25° C. and 30% relative humidity, it is estimated that certain embodiments of the present invention are capable of generating up to 11 L/hr of potable drinking water. Operating and physical parameters of the system can be modified to maximize water production and minimize fuel use during operation in these conditions. Table 1 below lists expected performance metrics for a typical system embodied according to the present invention.

TABLE 1

| Performance Metrics | |
|---|---|
| Water Generation Rate | 11 liters per hour |
| Water to Fuel Ratio | 7:1 |
| Equivalent Mass Generation | 20 hours |
| Equivalent Volume Generation | 140 hours |
| Humidity Concentration Factor | 70% |

Table 2 below lists nominal physical parameters for a typical system embodied according to the present invention.

TABLE 2

| Physical Parameters | |
|---|---|
| System Mass | 230 kg |
| System Volume | 1500 liters |

TABLE 2-continued

| Physical Parameters | |
|---|---|
| Fuel Type | DL2, JP8 |
| Fuel Tank Capacity | 20 liters |
| Operating Time (per tank) | 10 hours |
| Water Storage Capacity | 115 liters |
| Auxiliary Power Output | up to 1.5 kilowatts (varies with ambient cond.) |

The performance metrics and physical parameters shown above are based on experimental data collected during operation of the system of Working Example #3 and on feasibility studies of the primary system components. In the system of Working Example #3, approximately 3.2 kW of heat from the engine cooling system was used to extract water from the desiccant. An improved embodiment can recover 20% of the energy from the desorption process and utilize approximately 85% (or 3.6 kilowatts) of the available waste energy generated by the improved system engine. The combined available energy will be 7.5 kilowatts. Based on the performance data collected during operation of the system of Working Example #3 it has been determined that 1.6 kW of heat is needed to generate 1.0 liter per hour of water. Therefore, using only the waste engine heat to drive the desorption process, approximately 4.7 liters/hour of water can be generated.

Figure 9:
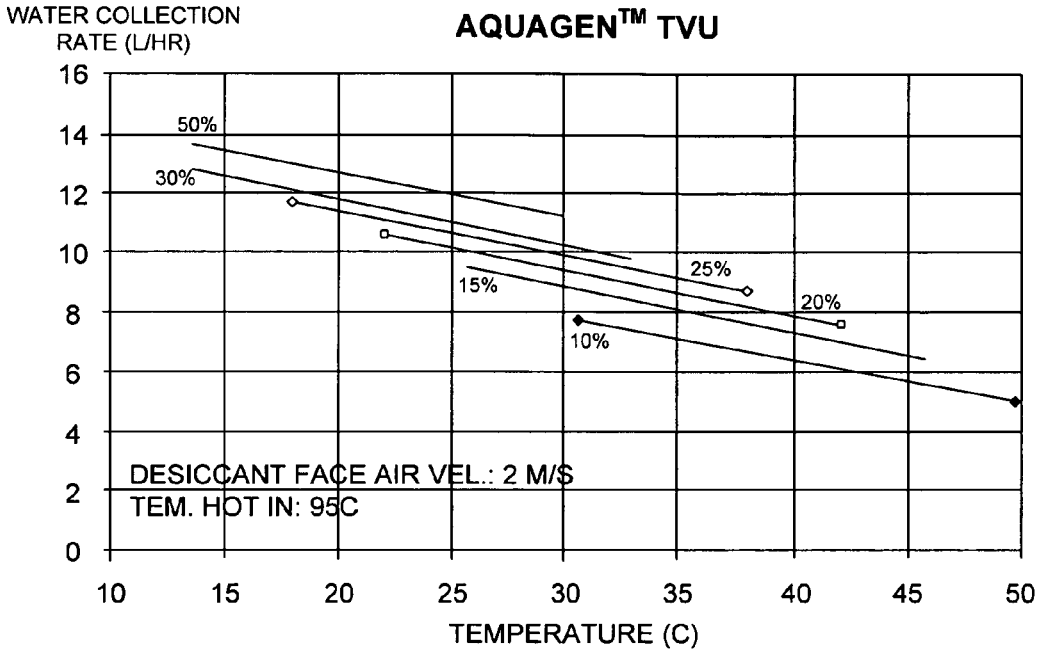
FIG. 9 illustrates the theoretical relationship between water collection rate and various ambient conditions for an embodiment of the invention.

Referring to FIG. 9, the relationship is illustrated between theoretical water collection rate and various ambient conditions for the above-described alternate embodiment of the present invention. These relationships are based on the measured performance of the prototype system described above, coupled with calculations that account for the improved heat recovery, increased electrical power capacity, and the ESPAR fuel burner. Under the baseline ambient conditions of 25° C. and 30% relative humidity, a water-production rate of 11 L/h is expected. For the worst-case conditions of 49° C. (120° F.) and 3.2% relative humidity (20° F. dew point), the water-production rate is expected to be 4 L/h. Fuel consumption varies significantly with ambient conditions. Under worst-case hot/dry conditions, the water-to-fuel ratio will be roughly 4.2:1. Under the baseline conditions, the water-to-fuel ratio will be approximately 7:1.

To assure production of safe drinking water, the present invention will typically incorporate a filtration component in the effluent water stream. The preferred filter component can combine hollow-fiber membranes, granular activated carbon, and magnesium oxide to improve the taste of the product water and prevent contamination with biological pathogens. Such an effluent filter is envisioned as a low-cost, long-life consumable and can be designed to meet EPA efficacy standards for bacteria, protozoa, and viruses. Due to the relatively slow water-production rate, the effluent filter will typically operate via gravity drip and therefore require no power for operation.

To increase the production rate, a Hydronic Coolant Heater distributed by ESPAR will be incorporated into the design (for additional details, please refer to the specifications found at http://www.espar.com/htm/Specs/water/D9Wspec.htm). The Hydronic Coolant Heater can provide an additional 11 kilowatts of heat to use for desorption, resulting in a combined total of 18.3 kilowatts. The maximum fuel consumption for the ESPAR burner is 1.2 L/h. Fuel consumption for the generator is approximately 0.95 L/h.

Figure 10:
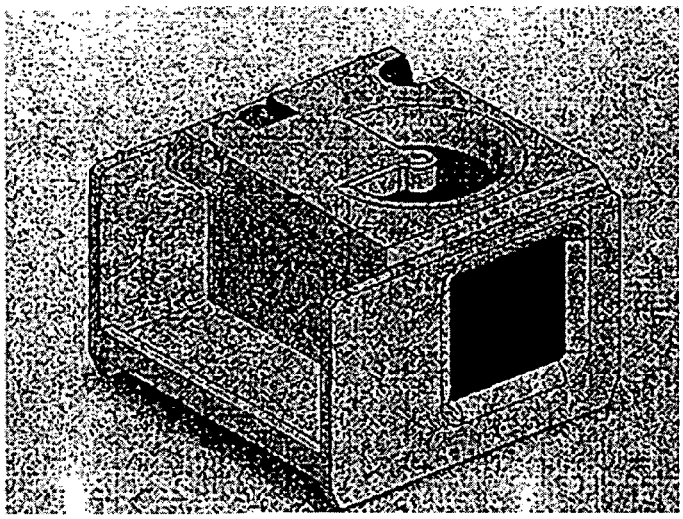
FIG. 10 illustrates an embodiment of the invention packaged for use with a vehicle.

Referring to FIG. 10, the principle is illustrated that the present invention can be packaged to make efficient use of space and to improve the versatility of the invention. The embodiment shown is designed so that the system frame fits within the space available in the back of a HMMWV (Humvee) military vehicle.

Figure 11:
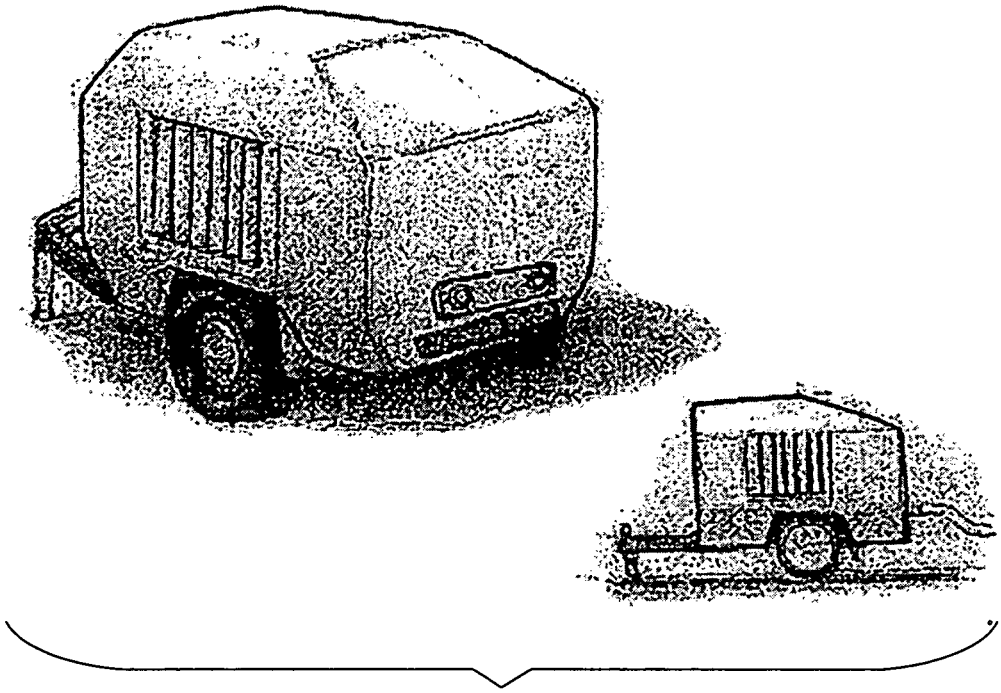
FIG. 11 illustrates a 1500 liter-per-day large capacity embodiment of the invention.

Referring to FIG. 11, a large capacity embodiment is illustrated that produces 1500 liters of water per day. This large capacity system is trailer-mounted and capable of producing 1500 liters (400 gal.) of water per day operating in 25° C. and 30% RH environmental conditions and 560 liters per day under extremely hot/dry conditions such as 49° C. (120° F.) and 3.2% relative humidity (20° F. dew point). As an example, the system is implemented with a 14.4 kW Marine Generator by ISUZU (245 kg mass, 390 L volume) for the electric generator, DRI metal silicate desiccant rotor (two each, 161 cm dia. by 20 cm deep, total desiccant wheel volume=410 L, total desiccant wheel mass=490 kg) for the desiccant wheel, three (3) Espar's Hydronic 30 water heaters (55 kg total mass, 91 L total volume) and 800 L total volume of condensers (410 kg total mass—est.). With fans and a ducting system, such a unit weighs approximately 1000 kg and has an external volume of approximately 5 $m^3$.

Figure 12:
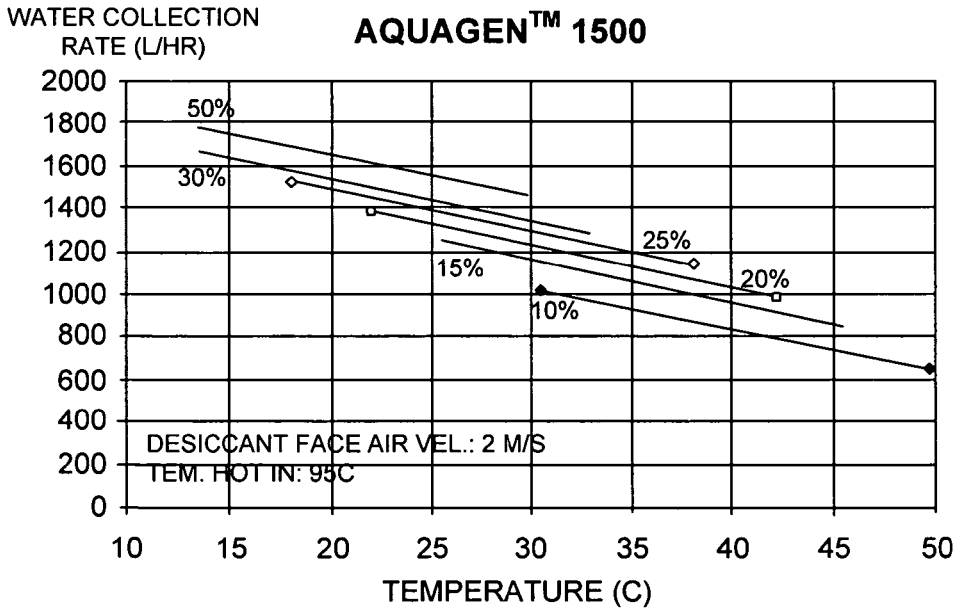
FIG. 12 illustrates the theoretical daily water collection rate under various ambient conditions for an embodiment of the invention.

FIG. 12 illustrates the theoretical daily water collection rate (assuming 20-h/day operation) under various ambient conditions of such a unit.

A system and method for extracting water from ambient air has been described in terms of various examples and embodiments. It will be understood by those skilled in the art that the present invention may be embodied in other specific forms without departing from the scope of the invention disclosed and that the examples and embodiments described herein are in all respects illustrative and not restrictive. Any reference to claim elements in the singular, for example, using the articles "a," "an," or "the" is not to -be construed as limiting the element to the singular. Those skilled in the art of the present invention will recognize that other embodiments using the concepts described herein are also possible.

What is claimed is:

1. Apparatus for extracting water from ambient air, comprising:

an adsorption fan disposed to force ambient air to contact a section of a desiccant rotor disposed within a main adsorption flow path;

a desorption fan disposed to force a closed loop of desorping air to contact a section of the desiccant rotor disposed within a main desorption flow path;

a condenser disposed to contact the desorping air so that water vapor in the desorping air is condensed as liquid water;

a main heat exchanger disposed to contact the desorping air so that the temperature of the desorping air is raised by heat energy transferred via the main heat exchanger;

a second heat exchanger having a hot side and a cold side;

a pre-heating flow path for conveying preheating air into contact with the hot side of the second heat exchanger so that heat energy is transferred into the pre-heating air, and into contact with a preheating section of the desiccant rotor, so as to pre-heat a portion of the desiccant rotor before the portion is exposed to the desorping air;

a pre-heating circulation fan disposed to force the pre-heating air along the pre-heating flow path;

a heat recovery flow path for conveying heat recovery air that has been heated by contact with a heat recovery section of the desiccant rotor to contact the cold side of the second heat exchanger, so that the heat recovery air transfers heat energy through the second heat exchanger to the preheating air; and a heat recovery circulation fan disposed to force the heat recovery air to flow along the heat recovery flow path.

2. The apparatus for extracting water from ambient air of claim 1, wherein the desiccant rotor rotates, and wherein the pre-heating flow path is disposed between the main adsorption flow path and the main desorption flow path where the desiccant rotor moves from the main adsorption flow path into the main desorption flow path.

3. The apparatus for extracting water from ambient air of claim 1, wherein the desiccant rotor rotates, and wherein the heat recovery flow path is disposed between the main adsorption flow path and the main desorption flow path where the desiccant rotor moves from the main desorption flow path into the main adsorption flow path.

4. The apparatus for extracting water from ambient air of claim 1, wherein the heat energy transferred via the main heat exchanger is provided from an energy conversion device.

5. The apparatus for extracting water from ambient air of claim 4, wherein the energy conversion device comprises an internal combustion engine.

6. The apparatus for extracting water from ambient air of claim 5, wherein the heat energy transferred via the main heat exchanger is provided from exhaust of the internal combustion engine.

7. The apparatus for extracting water from ambient air of claim 5, wherein the heat energy transferred via the main heat exchanger is provided from coolant of the internal combustion engine.

8. The apparatus for extracting water from ambient air of claim 5, wherein the internal combustion engine comprises a diesel engine.

9. The apparatus for extracting water from ambient air of claim 5, further comprising:

an electrical generator driven by the internal combustion engine, wherein electricity produced by the electrical generator provides power to drive the adsorption fan, the desorption fan, the pre-heating circulation fan, and the heat recovery circulation fan.

10. The apparatus for extracting water from ambient air of claim 9, wherein a generating capacity of the electrical generator is substantially matched to a mechanical peak-efficiency operating condition of the internal combustion engine.

11. The apparatus for extracting water from ambient air of claim 4, wherein the energy conversion device comprises an external fuel burner.

12. The apparatus for extracting water from ambient air of claim 4, wherein the energy conversion device comprises a solar collector.

13. The apparatus for extracting water from ambient air of claim 4, wherein the energy conversion device comprises an ohmic heater.

14. The apparatus for extracting water from ambient air of claim 1, wherein water is extracted at a rate of at least about four liters per hour when the ambient air temperature is 120° F. and ambient air relative humidity is 3.2%.

15. The apparatus for extracting water from ambient air of claim 1, wherein the adsorption fan comprises two or more fans operating together.

16. Apparatus for extracting water from ambient air, comprising:

a desiccant rotor that is configured to rotate so that sections of the desiccant rotor are successively exposed to different airflows at the desiccant rotor rotates, including an adsorption airflow, a pre-heating airflow, a desorping airflow, and a heat recovery airflow;

means for forcing ambient air comprising the adsorption airflow to flow in a main adsorption flow path and to contact a portion of the desiccant rotor currently rotating past the adsorption airflow, so that moisture is absorbed from the ambient air by said portion of the desiccant rotor;

means for forcing a closed loop of the desorping airflow within a main desorption flow path to contact a portion of the desiccant rotor currently rotating past the desorping airflow, so that moisture previously adsorbed by the desiccant rotor is transferred to the desorping airflow;

a condenser coupled in fluid communication with both the main absorption flow path and the main desorption flow path, to transfer heat energy from the desorping airflow to the adsorption airflow, after the moisture has been transferred to the desorping airflow from the desiccant rotor, whereby water vapor in the desorping airflow is condensed at the condenser to form liquid water when the desorping airflow is thus cooled by the heat energy transfer at the condenser;

means for passing the desorping air over the condenser;

a main heat exchanger that is coupled in fluid communication with the condenser to receive the desorping airflow after the water vapor has been condensed from the desorping airflow, and to receive a warm fluid from a heat source, the main heat exchanger transferring heat energy from the warm fluid to the desorping airflow before the desorping airflow again contacts the desiccant rotor;

means for contacting the desorping airflow with the main heat exchanger;

a second heat exchanger in fluid communication with the heat recovery airflow and the pre-heat airflow so as to transfer heat energy from the heat recovery airflow to the pre-heat airflow;

means for forcing the pre-heating airflow to contact a portion of the desiccant rotor currently rotating past a pre-heating flow path after the pre-heating airflow has been heated at the second heat exchanger; and means for forcing the heat recovery airflow to contact a portion of the desiccant rotor currently rotating past a heat recovery flow path, and to be heated by the desiccant rotor before contacting the second heat exchanger.

* * * * *